US010570724B2

(12) United States Patent
Wang et al.

(10) Patent No.: US 10,570,724 B2
(45) Date of Patent: Feb. 25, 2020

(54) SENSING SUB-ASSEMBLY FOR USE WITH A DRILLING ASSEMBLY

(71) Applicant: General Electric Company, Schenectady, NY (US)

(72) Inventors: Chengbao Wang, Oklahoma City, OK (US); Xuele Qi, Edmond, OK (US); Stewart Blake Brazil, Edmond, OK (US); Yi Liao, Edmond, OK (US)

(73) Assignee: General Electric Company, Schenectady, NY (US)

( * ) Notice: Subject to any disclaimer, the term of this patent is extended or adjusted under 35 U.S.C. 154(b) by 349 days.

(21) Appl. No.: 15/711,355

(22) Filed: Sep. 21, 2017

(65) Prior Publication Data

US 2018/0087373 A1 Mar. 29, 2018

Related U.S. Application Data

(60) Provisional application No. 62/398,923, filed on Sep. 23, 2016.

(51) Int. Cl.
*E21B 49/08* (2006.01)
*E21B 47/10* (2012.01)
(Continued)

(52) U.S. Cl.
CPC ..... *E21B 47/10* (2013.01); *E21B 47/00* (2013.01); *E21B 34/08* (2013.01); *E21B 49/081* (2013.01);
(Continued)

(58) Field of Classification Search
CPC ..... E21B 49/088
See application file for complete search history.

(56) References Cited

U.S. PATENT DOCUMENTS 2,187,486 A 1/1940 Burt
3,673,864 A 7/1972 Cubberly, Jr.
(Continued)

FOREIGN PATENT DOCUMENTS

CN 101280680 A 10/2008
EP 1064452 A1 1/2001
(Continued)

OTHER PUBLICATIONS

Erzinger, et al., "Real-time mud gas logging and sampling during drilling," Geofluids, vol. 6, Issue. 3, pp. 225-233 (2006) (Abstract).
(Continued)

*Primary Examiner* — Clayton E. LaBalle
*Assistant Examiner* — Dennis Hancock
(74) *Attorney, Agent, or Firm* — Laura L. Pollander

(57) ABSTRACT

A sensing system that includes a cylindrical body including an internal flow channel that channels a first fluid therethrough, and a sampling chamber. The sampling chamber is in flow communication with an ambient environment. A venturi device is coupled within the cylindrical body, and the venturi device includes a high pressure portion and a low pressure portion. The low pressure portion is in flow communication with the sampling chamber. A valve is coupled within the cylindrical body and is positionable in at least a first position. A first flow channel is defined between the internal flow channel and the high pressure portion through the valve. The first flow channel channels the first fluid towards the high pressure portion such that the low pressure portion draws a second fluid into the sampling chamber from the ambient environment. A sensor assembly determines characteristics of the second fluid within the sampling chamber.

20 Claims, 10 Drawing Sheets

(51) Int. Cl.
*E21B 47/00* (2012.01)
*E21B 34/08* (2006.01)

(52) U.S. Cl.
CPC ..... *E21B 49/088* (2013.01); *E21B 2049/085* (2013.01)

(56) References Cited

U.S. PATENT DOCUMENTS

| | | | | |
|---|---|---|---|---|
| 4,578,579 | A | 3/1986 | Dion | |
| 5,680,043 | A | 10/1997 | Hurlimann et al. | |
| 6,276,190 | B1 | 8/2001 | Zamfes | |
| 6,290,000 | B1 | 9/2001 | Zamfes | |
| 6,768,106 | B2 | 7/2004 | Gzara et al. | |
| 7,804,060 | B2 | 9/2010 | Guo et al. | |
| 7,814,782 | B2 | 10/2010 | DiFoggio | |
| 8,056,408 | B2 | 11/2011 | Pop et al. | |
| 8,689,904 | B2 | 4/2014 | Coates et al. | |
| 8,714,246 | B2 | 5/2014 | Pop et al. | |
| 8,794,350 | B2 | 8/2014 | Alberty | |
| 9,019,118 | B2 | 4/2015 | Milne et al. | |
| 9,040,901 | B2 | 5/2015 | Harlow | |
| 9,109,433 | B2 | 8/2015 | Difoggio et al. | |
| 9,702,249 | B2 * | 7/2017 | Gordon | E21B 47/10 |
| 2007/0261486 | A1 * | 11/2007 | Fallet | E21B 47/10 73/152.29 |
| 2008/0047337 | A1 | 2/2008 | Chemali et al. | |
| 2011/0132601 | A1 | 6/2011 | Pettinato et al. | |
| 2013/0113480 | A1 | 5/2013 | Kadayam et al. | |
| 2013/0234012 | A1 | 9/2013 | Morris et al. | |
| 2015/0122505 | A1 | 5/2015 | Judge et al. | |
| 2015/0136961 | A1 | 5/2015 | Eddy et al. | |
| 2015/0260703 | A1 | 9/2015 | Mitchell | |
| 2018/0298748 | A1 * | 10/2018 | Rustad | E21B 37/06 |

FOREIGN PATENT DOCUMENTS

| | | | |
|---|---|---|---|
| WO | 0173424 | A1 | 10/2001 |
| WO | 2015026394 | A1 | 2/2015 |

OTHER PUBLICATIONS

Parkey, J. D. L., et al., "System and method of sensing hydrocarbons in a subterranean rock formation," GE Co-Pending Application No. PCT/CN2017/070276, filed on Jan. 5, 2017.

International Search Report and Written Opinion issued in connection with corresponding PCT Application No. PCT/US2017/053188 dated Nov. 14, 2017.

* cited by examiner

SENSING SUB-ASSEMBLY FOR USE WITH A DRILLING ASSEMBLY

CROSS-REFERENCE TO RELATED APPLICATIONS

This application claims priority to U.S. Patent Application Ser. No. 62/398,923, filed Sep. 23, 2016 for "SENSING SUB-ASSEMBLY FOR USE WITH A DRILLING ASSEMBLY," which is incorporated by reference herein in its entirety.

BACKGROUND

The present disclosure relates generally to wellbore drilling and formation evaluation and, more specifically, to a Logging-While-Drilling or Measurement-While-Drilling sensing system for downhole hydrocarbon and gas species detection when forming a wellbore in a subterranean rock formation.

Hydraulic fracturing, commonly known as fracking, is a technique used to release petroleum, natural gas, and other hydrocarbon-based substances for extraction from underground reservoir rock formations, especially for unconventional reservoirs. The technique includes drilling a wellbore into the rock formations, and pumping a treatment fluid into the wellbore, which causes fractures to form in the rock formations and allows for the release of trapped substances produced from these subterranean natural reservoirs. At least some known unconventional subterranean wells are evenly fractured along the length of the wellbore. However, typically less than 50 percent of the fractures formed in the rock formations contribute to hydrocarbon extraction and production for the well. As such, hydrocarbon extraction from the well is limited, and significant cost and effort is expended for completing non-producing fractures in the wellbore.

BRIEF DESCRIPTION

In one aspect, a sensing system for use in downhole hydrocarbon and gas species detection is provided. The sensing system includes a cylindrical body including an internal flow channel configured to channel a first fluid therethrough, and a sampling chamber defined therein. The sampling chamber is coupled in flow communication with an ambient environment exterior of the cylindrical body. A venturi device is coupled within the cylindrical body, and the venturi device includes a high pressure portion and a low pressure portion. The low pressure portion is coupled in flow communication with the sampling chamber. A valve is coupled within the cylindrical body, and the valve is selectively positionable in at least a first position of a plurality of positions. A first flow channel is defined between the internal flow channel and the high pressure portion of the venturi device through the valve when the valve is in the first position. The first flow channel is configured to channel the first fluid towards the high pressure portion such that the low pressure portion draws a second fluid into the sampling chamber from the ambient environment. A sensor assembly is coupled within the cylindrical body, and the sensor assembly is configured to determine characteristics of the second fluid within the sampling chamber.

In another aspect, a sampling hub for use in a sensing sub-assembly is provided. The sampling hub includes a cylindrical body including an internal flow channel extending therethrough and configured to channel a first fluid therethrough, a sampling chamber defined therein coupled in selective flow communication with an ambient environment exterior of the cylindrical body and with the internal flow channel, and at least one sensor chamber defined therein and in communication with the sampling chamber. A venturi device is coupled within the cylindrical body. The venturi device includes a high pressure portion and a low pressure portion, wherein the low pressure portion is coupled in flow communication with the sampling chamber. A valve is coupled within the cylindrical body, and the valve is selectively positionable in at least a first position of a plurality of positions. A first flow channel is defined between the internal flow channel and the high pressure portion of the venturi device through the valve when the valve is in the first position. The first flow channel is configured to channel the first fluid towards the high pressure portion such that the low pressure portion draws a second fluid into the sampling chamber from the ambient environment.

In yet another aspect, a drilling assembly is provided. The drilling assembly includes a first sub-assembly including at least one of a measurement-while-drilling sub-assembly or a logging-while-drilling sub-assembly, and a sensing sub-assembly coupled to the first sub-assembly. The sensing sub-assembly includes a cylindrical body including an internal flow channel configured to channel a first fluid therethrough, and a sampling chamber defined therein. The sampling chamber is coupled in flow communication with an ambient environment exterior of the cylindrical body. A venturi device is coupled within the cylindrical body, and the venturi device includes a high pressure portion and a low pressure portion. The low pressure portion is coupled in flow communication with the sampling chamber. A valve is coupled within the cylindrical body, and the valve is selectively positionable in at least a first position of a plurality of positions. A first flow channel is defined between the internal flow channel and the high pressure portion of the venturi device through the valve when the valve is in the first position. The first flow channel is configured to channel the first fluid towards the high pressure portion such that the low pressure portion draws a second fluid into the sampling chamber from the ambient environment. A sensor assembly is coupled within the cylindrical body, and the sensor assembly is configured to determine characteristics of the second fluid within the sampling chamber.

DRAWINGS

These and other features, aspects, and advantages of the present disclosure will become better understood when the following detailed description is read with reference to the accompanying drawings in which like characters represent like parts throughout the drawings, wherein.

Figure 1:
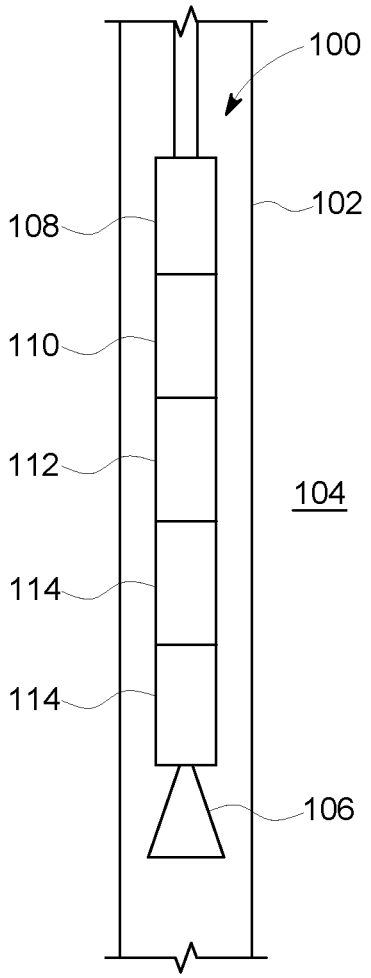
FIG. 1 is a schematic illustration of an exemplary drilling assembly that may be used to form a wellbore.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged. Such ranges are identified and include all the sub-ranges contained therein unless context or language indicates otherwise.

Embodiments of the present disclosure relate to a sensing system for downhole hydrocarbon and gas species detection when forming a wellbore in a subterranean rock formation. The sensing system is implemented as a standalone evaluation tool or installed as part of a wellbore drilling assembly. The sensing system obtains fluid samples from fluid flows that are either channeled into the wellbore through the drilling assembly or that backflow within the wellbore past the drilling assembly. More specifically, pressure differentials and a venturi device are implemented such that the fluid samples are obtained in a simplified and efficient manner. The sensing system includes one or more sensors that obtain measurements of the sampled fluid. The measurement results are used to identify potentially promising fracture initiation zones within the wellbore such that efficient and cost effective completion planning can be implemented.

For example, downhole hydrocarbon and gas species detection while drilling can identify zones of high permeability, such as open natural fractures, clusters of closed but unsealed natural fractures, larger pores and other formation features where hydrocarbons are stored. The measurement results can be used to identify the most promising fracture initiation points or zones, and the information can be used for completion planning, especially for unconventional reservoirs. In addition, the measurement results can be used to identify poor zones (no gas show), which facilitates reducing the time and effort of perforating and stimulating the poor zones. Another potential application is for geosteering assistance, wherein the real time gas show/species information is used to adjust the borehole position (e.g., inclination and azimuth angles) while drilling, such that a well having increased production can be formed. Finally, real time measurement can also provide kick detection for real-time alerts of gas flow potential for safety and environmental considerations, thereby reducing the risk of catastrophic failure.

FIG. 1 is a schematic illustration of an exemplary drilling assembly 100 that may be used to form a wellbore 102 in a subterranean rock formation 104. In the exemplary embodiment, drilling assembly 100 includes a plurality of sub-assemblies and a drill bit 106. More specifically, the plurality of sub-assemblies include a measurement-while-drilling or logging-while-drilling sub-assembly 108, a sensing sub-assembly 110, a mud motor 112, and bent housing or rotary steerable system sub-assemblies 114 coupled together in series. Drilling assembly 100 includes any arrangement of sub-assemblies that enables drilling assembly 100 to function as described herein.

Figure 2:
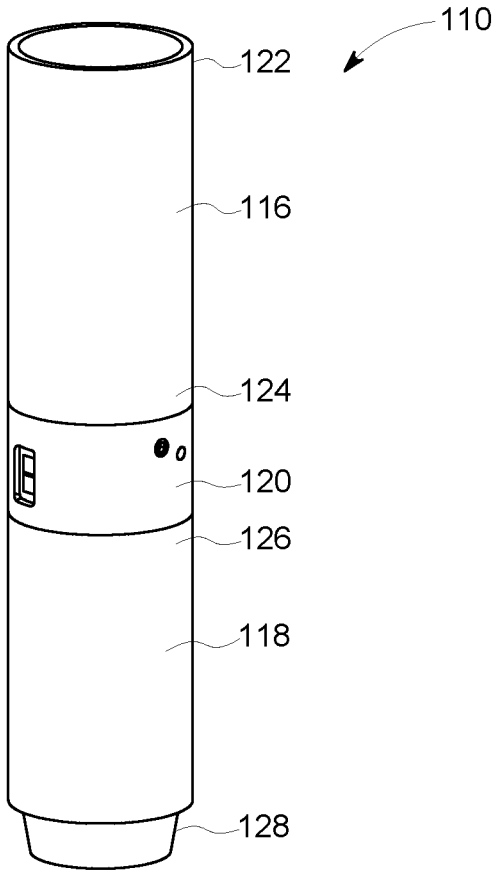
FIG. 2 is a perspective view of an exemplary sensing sub-assembly that may be used in the drilling assembly shown in FIG. 1.
Figure 3:
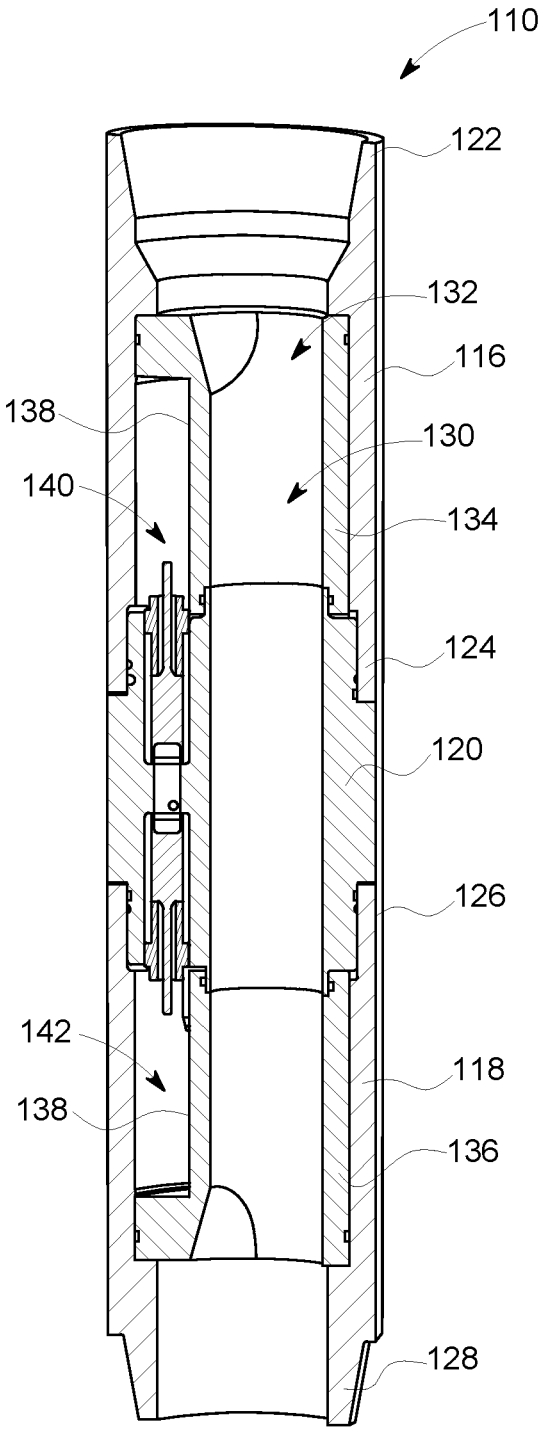
FIG. 3 is a cross-sectional view of the sensing sub-assembly shown in FIG. 2.

FIG. 2 is a perspective view of sensing sub-assembly 110 that may be used in drilling assembly 100 (shown in FIG. 1), and FIG. 3 is a cross-sectional view of sensing sub-assembly 110. In the exemplary embodiment, sensing sub-assembly 110 includes a first outer casing 116, a second outer casing 118, and a sampling hub 120 coupled therebetween. First outer casing 116 includes a first end 122 and a second end 124, and second outer casing 118 includes a first end 126 and a second end 128. First end 122, second end 124, first end 126, and second end 128 each include a threaded connection for coupling sensing sub-assembly 110 to one or more of the plurality of sub-assemblies of drilling assembly 100, and for coupling first outer casing 116 and second outer casing 118 to sampling hub 120.

Referring to FIG. 3, sensing sub-assembly 110 includes an interior 130 defined by an internal flow channel 132 extending therethrough. In addition, sensing sub-assembly 110 includes a first chassis 134 and a second chassis 136 coupled on opposing ends of sampling hub 120. Portions of internal flow channel 132 are defined by, and extend through, sampling hub 120, first chassis 134, and second chassis 136, as will be described in more detail below.

In the exemplary embodiment, first chassis 134 and second chassis 136 are each formed with a circumferential indent 138 such that a first electronics chamber 140 is defined between first chassis 134 and first outer casing 116, and such that a second electronics chamber 142 is defined between second chassis 136 and second outer casing 118. First electronics chamber 140 and second electronics chamber 142 are sealed from internal flow channel 132 such that electronics (not shown) housed therein are protected from high pressure fluid channeled through internal flow channel 132 during operation of drilling assembly 100.

Figure 4:
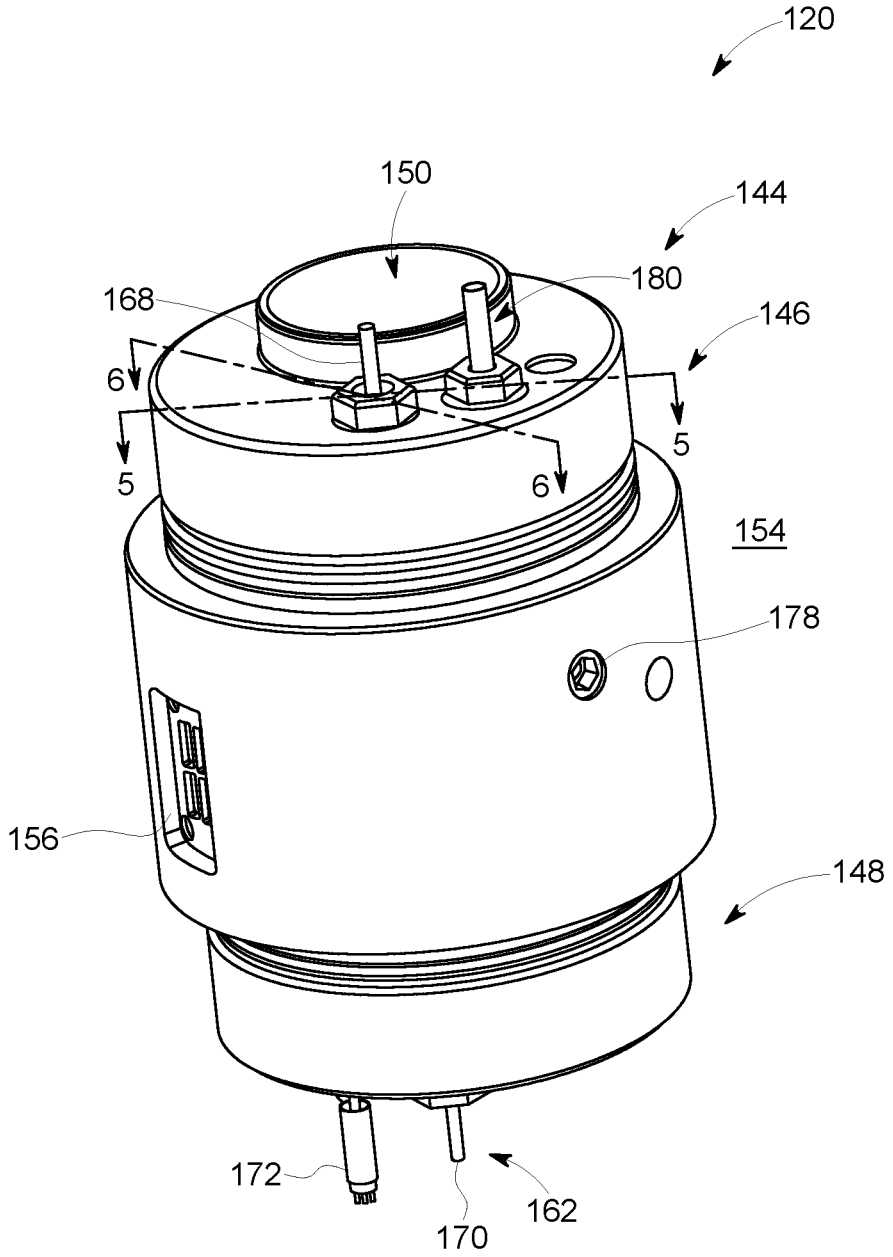
FIG. 4 is a perspective view of an exemplary sampling hub that may be used in the sensing sub-assembly shown in FIG. 2.
Figure 5:
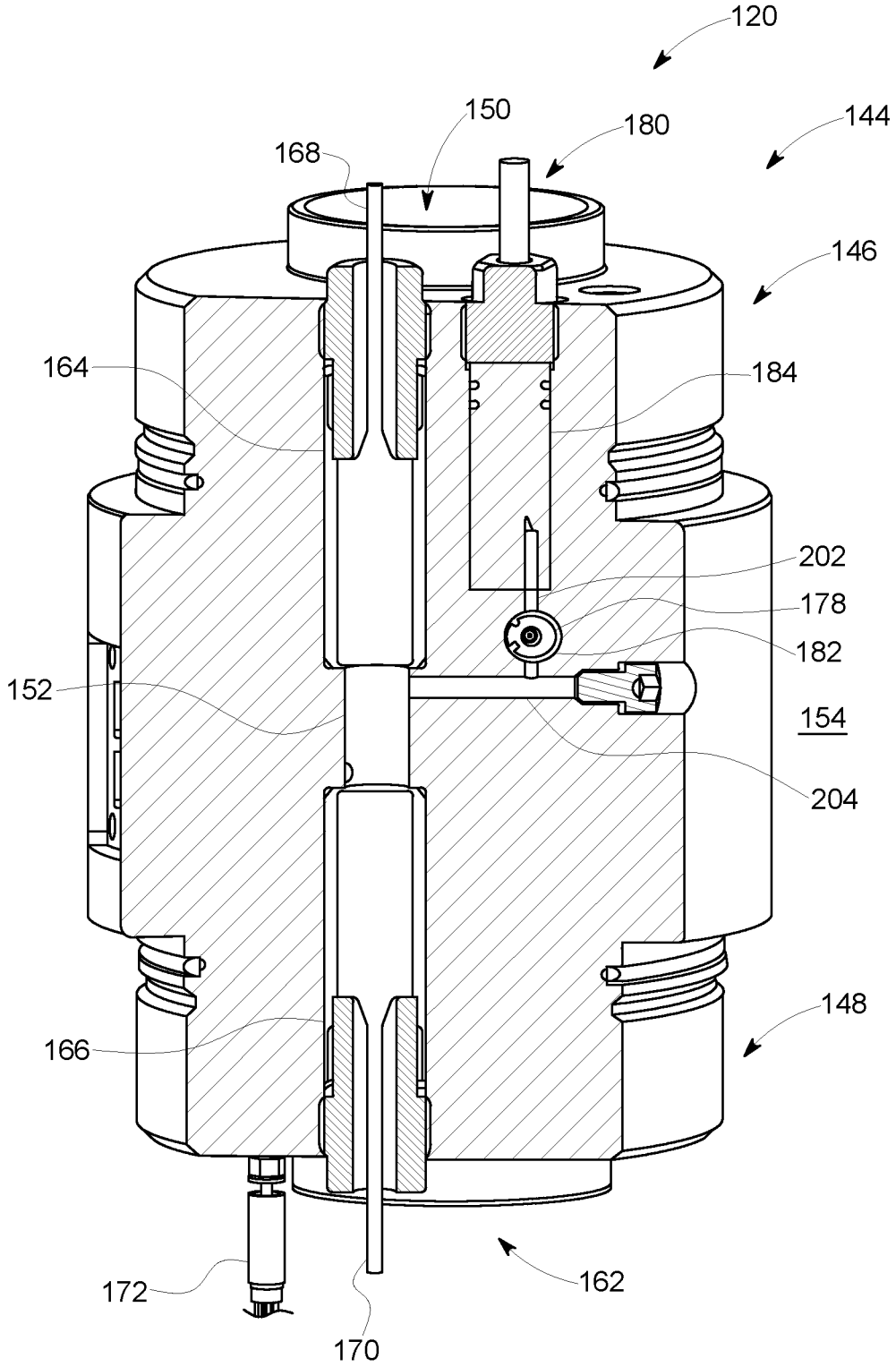
FIG. 5 is a cross-sectional view of the sampling hub shown in FIG. 3, taken along Line 5-5.
Figure 6:
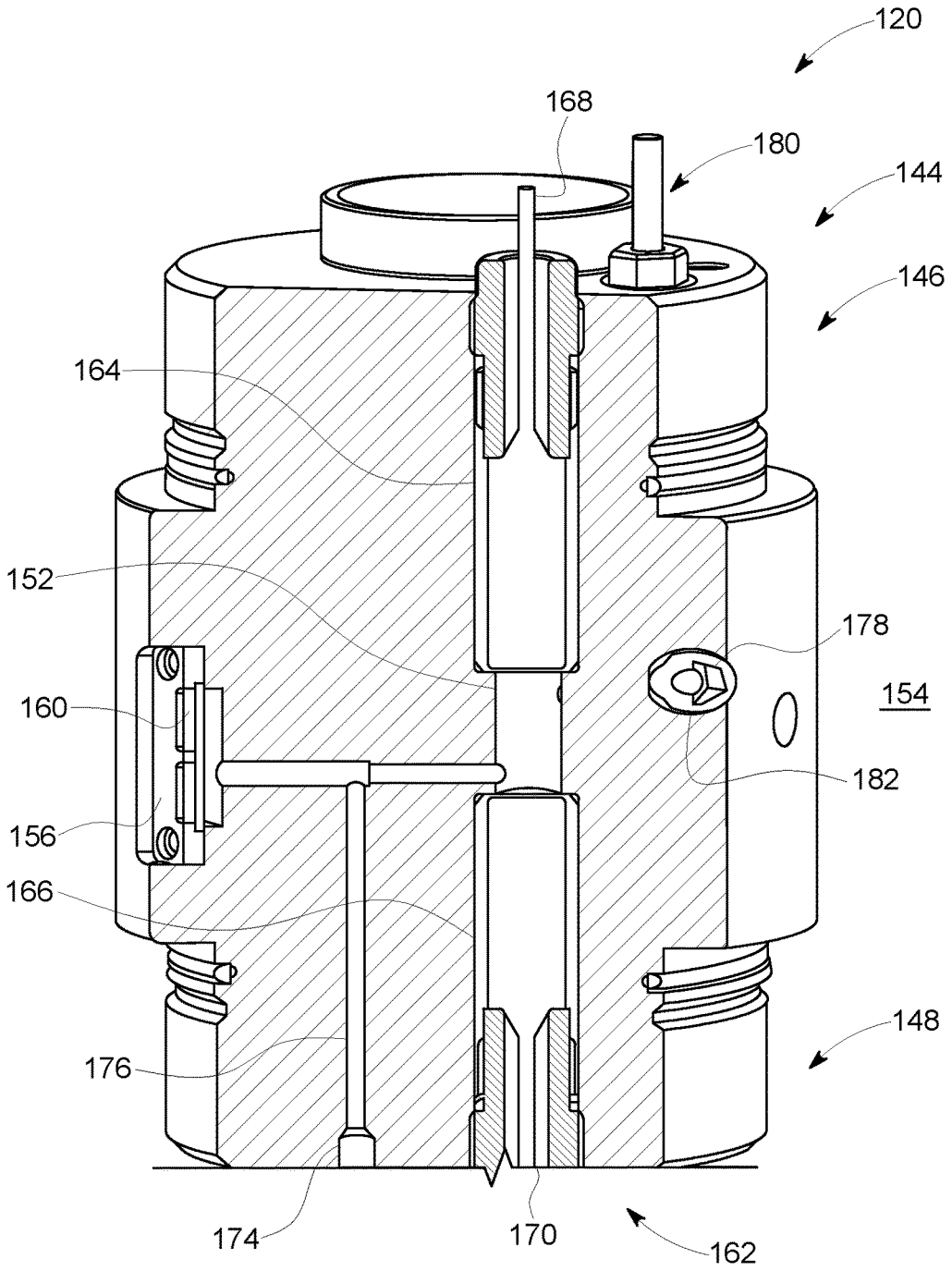
FIG. 6 is a cross-sectional view of the sampling hub shown in FIG. 3, taken along Line 6-6.

FIG. 4 is a perspective view of sampling hub 120 that may be used in sensing sub-assembly 110 (shown in FIG. 2), FIG. 5 is a cross-sectional view of sampling hub 120, taken along Line 5-5 (shown in FIG. 3), and FIG. 6 is a cross-sectional view of sampling hub 120, taken along Line 6-6 (shown in FIG. 3). In the exemplary embodiment, sampling hub 120 includes a cylindrical body 144 including a first end 146 and a second end 148. First end 146 and second end 148 each include a threaded connection for coupling to first outer casing 116 and second outer casing 118 (both shown in FIG. 3), as described above. In addition, cylindrical body 144 includes an internal flow channel 150 extending therethrough that channels high pressure fluid during operation of drilling assembly 100, as will be described in more detail below.

Referring to FIGS. 5 and 6, cylindrical body 144 further includes a sampling chamber 152 defined therein. Sampling chamber 152 is coupled in flow communication with an ambient environment 154 exterior of cylindrical body 144. More specifically, an exterior flow opening 156 is defined in cylindrical body 144, and a first interior conduit 158 extends between sampling chamber 152 and exterior flow opening 156. As such, in operation and as will be described in more detail below, low pressure fluid that backflows within wellbore 102 and past drilling assembly 100 (both shown in FIG. 1) is selectively channeled into sampling chamber 152. Moreover, sampling hub 120 includes a filter 160 that covers exterior flow opening 156 such that particulate matter entrained in the low pressure fluid is restricted from entering sampling chamber 152.

In the exemplary embodiment, sensing sub-assembly 110 includes a sensor assembly 162 coupled within cylindrical body 144. More specifically, cylindrical body 144 further includes a first sensor chamber 164 and a second sensor chamber 166 defined therein, and positioned at opposing ends of sampling chamber 152. Sensor assembly 162 includes a first sensor 168 positioned within first sensor chamber 164, and a second sensor 170 positioned within second sensor chamber 166. In one embodiment, first sensor 168 and second sensor 170 are acoustic transducers that determine the fluid density, sound speed, and signal attenuation of fluid contained within sampling chamber 152. Alternatively, any sensors for measuring characteristics of the fluid contained within sampling chamber 152 may be utilized that enables sensing sub-assembly 110 to function as described herein.

In addition, sensing sub-assembly 110 includes a third sensor 172 coupled within cylindrical body 144. More specifically, referring to FIG. 6, cylindrical body 144 includes a third sensor chamber 174 defined therein, and third sensor 172 is positioned within third sensor chamber 174. Third sensor chamber 174 is coupled in flow communication with first interior conduit 158 via a second interior conduit 176 that extends therebetween. In one embodiment, third sensor 172 is a pressure and temperature transducer that measures real-time pressure and temperature changes in the fluid channeled towards third sensor chamber 174, as will be described in more detail below. Alternatively, any sensor for determining characteristics of the fluid channeled towards third sensor chamber 174 may be utilized that enables sensing sub-assembly 110 to function as described herein.

Sensing sub-assembly 110 further includes a venturi device 178 and a valve 180 coupled within cylindrical body 144. More specifically, cylindrical body 144 includes a venturi chamber 182 and a valve chamber 184 defined therein. Venturi device 178 is positioned within venturi chamber 182, and valve 180 is positioned within valve chamber 184. Venturi device 178 includes a high pressure portion 186 and a low pressure portion 188 (both shown in FIGS. 7-10). High pressure portion 186 is selectively coupled in flow communication with internal flow channel 150 of cylindrical body 144 based on a position of valve 180, and low pressure portion 188 is coupled in flow communication with sampling chamber 152, as will be described in more detail below.

FIGS. 7-10 are internal views of sampling hub 120 including valve 180 in different operational positions. In the exemplary embodiment, valve 180 is selectively positionable in a plurality of positions, and includes a stationary element 190 and a rotatable element 192. Stationary element 190 includes a first flow passage 194 and a second flow passage 196 positioned at 0° and 180° positions, respectively, relative to a centerline 198 of valve 180. In addition, cylindrical body 144 further includes a third interior conduit 200 and a fourth interior conduit 202 defined therein. Third interior conduit 200 extends between first flow passage 194 and high pressure portion 186 of venturi device 178, and fourth interior conduit 202 facilitates coupling valve 180 in flow communication with sampling chamber 152. More specifically, as shown and also referring back to FIG. 5, cylindrical body 144 includes a fifth interior conduit 204 extending between sampling chamber 152 and fourth interior conduit 202.

Rotatable element 192 includes a circumferential slot 206 and a longitudinal slot 208 defined therein. Circumferential slot 206 and longitudinal slot 208 are coupled in flow communication with each other. In addition, stationary element 190 includes a third flow passage 210 defined therein, and cylindrical body 144 includes a sixth interior conduit 212 defined therein. Sixth interior conduit 212 extends between internal flow channel 150 and third flow passage 210.

Figure 7:
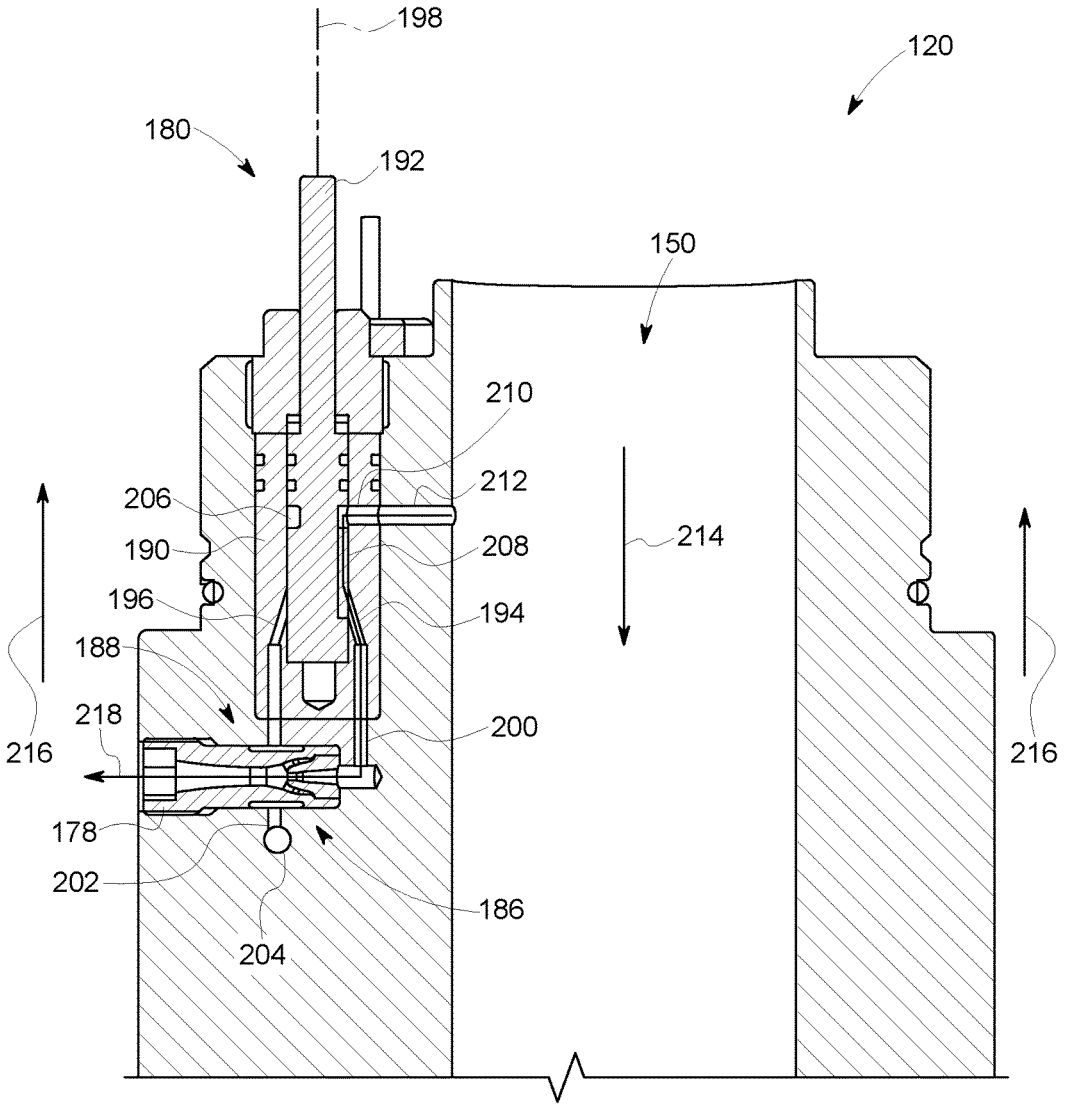
FIGS. 7-10 are internal views of the sampling hub shown in FIG. 3, including an exemplary valve in different operational positions.

During operation of drilling assembly 100 (shown in FIG. 1), a first fluid 214 is channeled through internal flow channel 150, and a second fluid 216 backflows within wellbore 102 (shown in FIG. 1) past drilling assembly 100. First fluid 214 flows at a greater pressure than second fluid 216. Referring to FIG. 7, valve 180 is in a first position of the plurality of positions for valve 180. More specifically, rotatable element 192 is in a 0° position relative to centerline 198 of valve 180. As such, a first flow channel 218 is defined between internal flow channel 150 and high pressure portion 186 of venturi device 178. More specifically, first fluid 214 flows from internal flow channel 150, through sixth interior conduit 212, through circumferential slot 206, through longitudinal slot 208, through first flow passage 194, through third interior conduit 200, and into high pressure portion 186 of venturi device 178. As such, a low pressure point is formed in low pressure portion 188 of venturi device 178. Because low pressure portion 188 is coupled in flow communication with sampling chamber 152, and because sampling chamber 152 is coupled in flow communication with ambient environment 154, a vacuum is formed in sampling chamber 152 and second fluid 216 is drawn through exterior flow opening 156 (shown in FIG. 6) and into sampling chamber 152 for analysis. In addition, second fluid 216 is drawn towards third sensor chamber 174 (shown in FIG. 6) for analysis.

Figure 8:
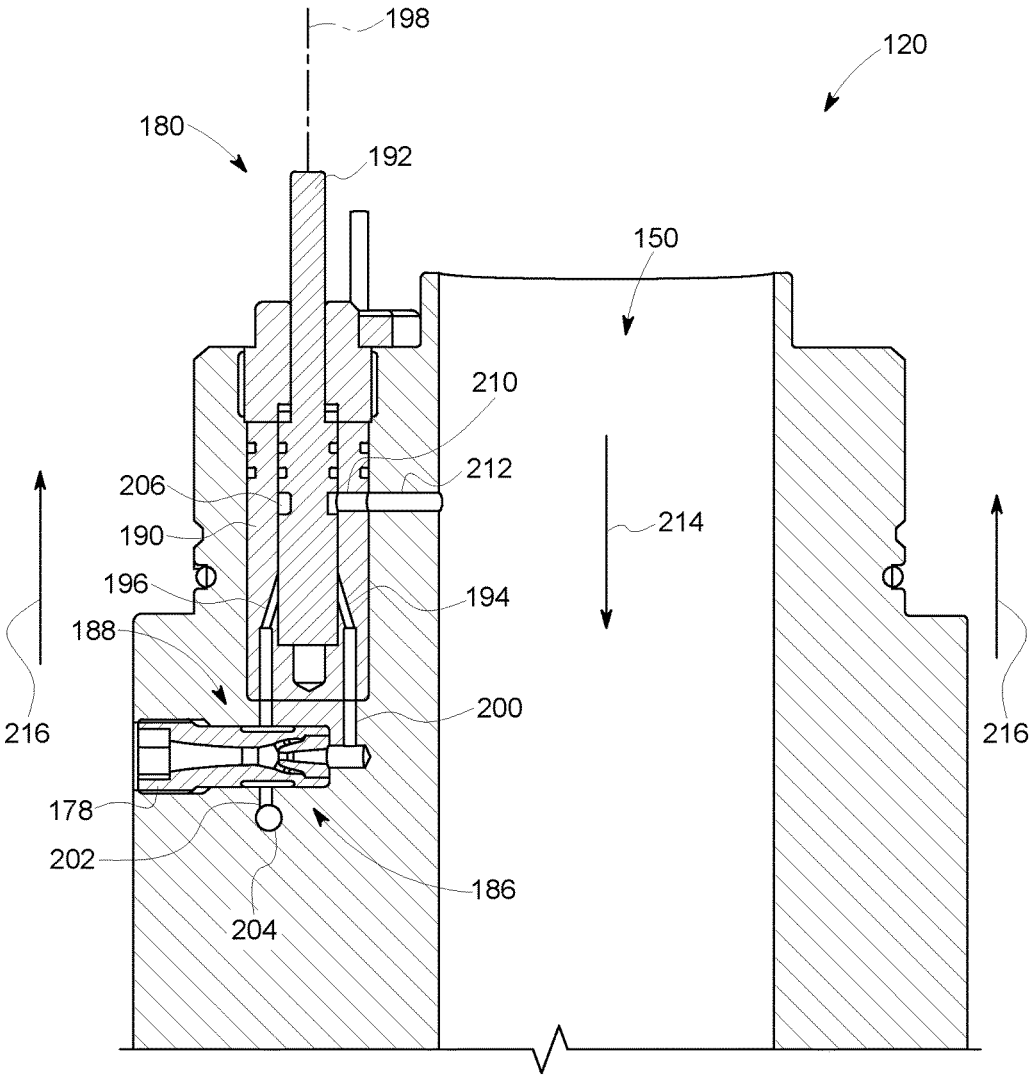

Referring to FIG. 8, valve 180 is in a second position of the plurality of positions for valve 180. More specifically, rotatable element 192 is in a 90° position relative to centerline 198 of valve 180. As such, longitudinal slot 208 (not shown in FIG. 8) is misaligned from first flow passage 194 and intake of second fluid 216 into sampling chamber 152 is stopped. Sensor assembly 162 and third sensor 172 (both shown in FIGS. 5 and 6) are then activated and characteristics of second fluid 216 are determined.

Figure 9:
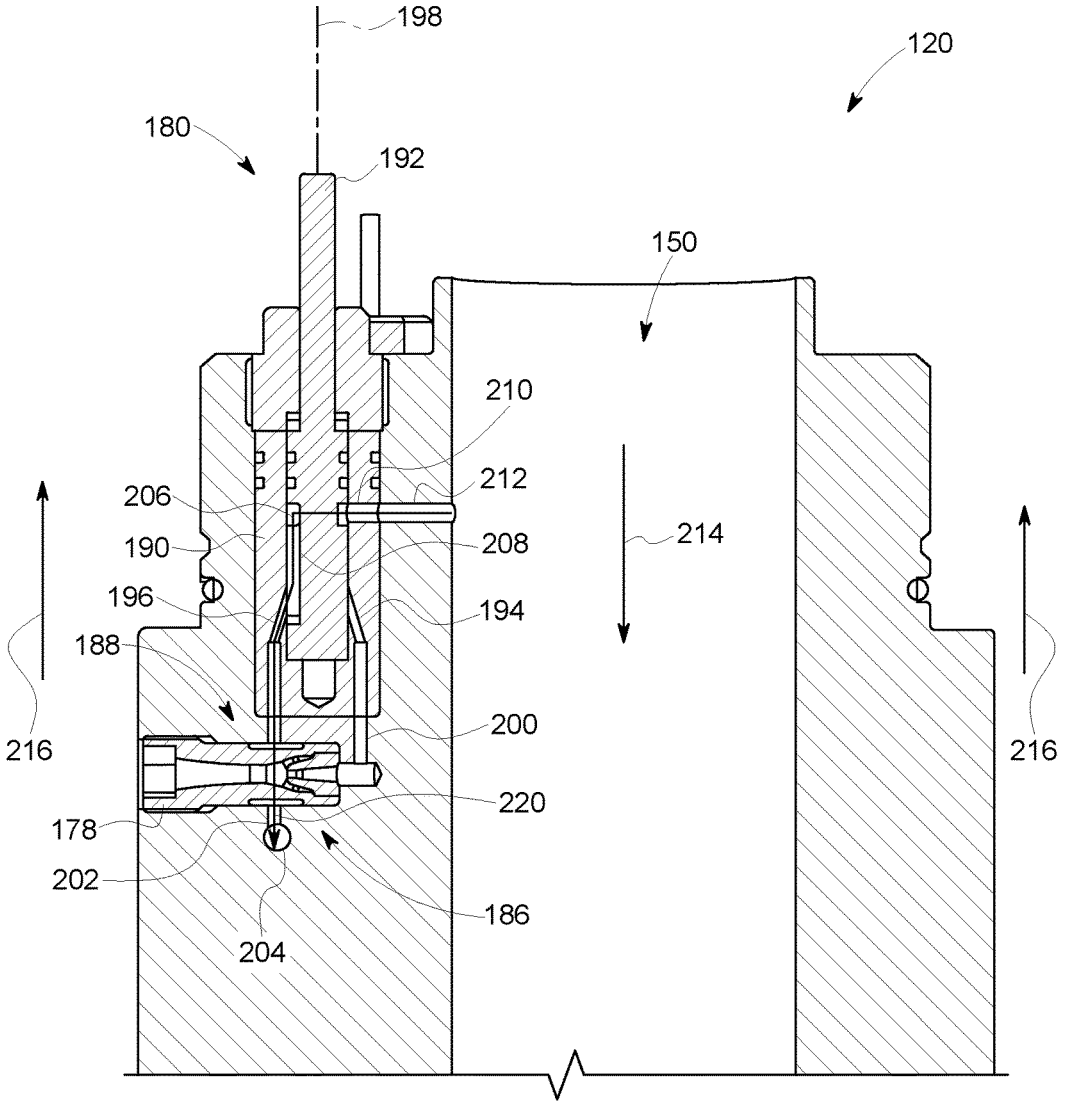

Referring to FIG. 9, valve 180 is in a third position of the plurality of positions for valve 180. More specifically, rotatable element 192 is in a 180° position relative to centerline 198 of valve 180. As such, a second flow channel 220 is defined between internal flow channel 150 and sampling chamber 152. More specifically, first fluid 214 flows from internal flow channel 150, through sixth interior conduit 212, through circumferential slot 206, through longitudinal slot 208, through second flow passage 196, through fourth interior conduit 202, through fifth interior conduit 204, and into sampling chamber 152. As such, second fluid 216 is purged from sampling chamber 152 and sampling chamber 152 is filled with first fluid 214 for analysis.

Figure 10:
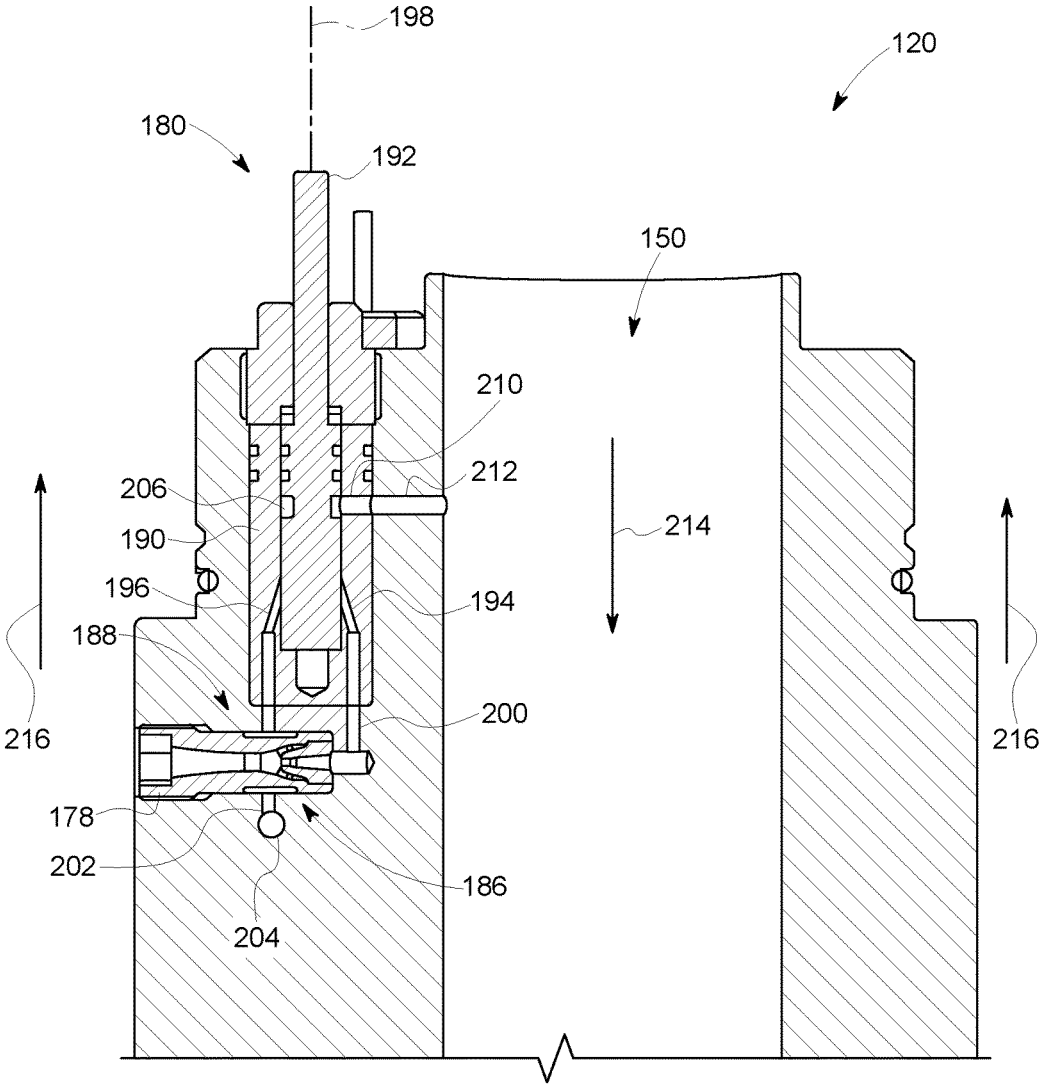

Referring to FIG. 10, valve 180 is in a fourth position of the plurality of positions for valve 180. More specifically, rotatable element 192 is in a 270° position relative to centerline 198 of valve 180. As such, longitudinal slot 208 (not shown in FIG. 10) is misaligned from second flow passage 196 and intake of first fluid 214 into sampling chamber 152 is stopped. Sensor assembly 162 and third sensor 172 (both shown in FIGS. 5 and 6) are then activated and characteristics of first fluid 214 are determined. In some embodiments, valve 180 recycles through the plurality of positions such that samples of first fluid 214 and second fluid 216 are obtained and analyzed either continuously, or at predetermined intervals. For example, in one embodiment, valve 180 is operable such that different samples are obtained within sampling chamber 152 at intervals less than or equal to one minute.

The systems and assemblies described herein facilitate providing at least semi-continuous hydrocarbon and gas species detection feedback when drilling unconventional subterranean wells. More specifically, the sensing sub-assembly provides a device that enables samples of fluid used in the drilling process to be obtained and analyzed in a fast and efficient manner. The data obtained from the analysis of the fluid samples can then be used to determine zones within a wellbore that have either a low likelihood or a high likelihood of having a high hydrocarbon content. As such, the zones having a high hydrocarbon content are identified, and fracture completion planning resulting in improved well production is determined.

An exemplary technical effect of the systems and assemblies described herein includes at least one of: (a) providing real-time and continuous hydrocarbon and gas species detection feedback when forming a well in a subterranean rock formation; (b) identifying potentially promising fracture initiation zones within a wellbore; (c) improving hydrocarbon production for wells; (d) providing geosteering assistance for the drilling assembly; and (e) providing kick detection for real-time gas flow potential safety alerts.

Exemplary embodiments of a sensing system, and related components are described above in detail. The sensing system is not limited to the specific embodiments described herein, but rather, components of systems and/or steps of the methods may be utilized independently and separately from other components and/or steps described herein. For example, the configuration of components described herein may also be used in combination with other processes, and is not limited to practice with only drilling and sensing assemblies and related methods as described herein. Rather, the exemplary embodiment can be implemented and utilized in connection with many applications where sampling and analyzing one or more fluids is desired.

Although specific features of various embodiments of the present disclosure may be shown in some drawings and not in others, this is for convenience only. In accordance with the principles of embodiments of the present disclosure, any feature of a drawing may be referenced and/or claimed in combination with any feature of any other drawing.

This written description uses examples to disclose the embodiments of the present disclosure, including the best mode, and also to enable any person skilled in the art to practice embodiments of the present disclosure, including making and using any devices or systems and performing any incorporated methods. The patentable scope of the embodiments described herein is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A sensing system for use in downhole hydrocarbon and gas species detection, said sensing system comprising:

a cylindrical body comprising:

an internal flow channel extending therethrough, said internal flow channel configured to channel a first fluid therethrough; and a sampling chamber defined therein, said sampling chamber coupled in flow communication with an ambient environment exterior of said cylindrical body;

a venturi device coupled within said cylindrical body, said venturi device comprising a high pressure portion and a low pressure portion, wherein said low pressure portion is coupled in flow communication with said sampling chamber;

a valve coupled within said cylindrical body, said valve selectively positionable in at least a first position of a plurality of positions, wherein a first flow channel is defined between said internal flow channel and said high pressure portion of said venturi device through said valve when said valve is in the first position, said first flow channel configured to channel the first fluid towards said high pressure portion such that said low pressure portion draws a second fluid into said sampling chamber from the ambient environment; and a sensor assembly coupled within said cylindrical body, said sensor assembly configured to determine characteristics of the second fluid within said sampling chamber.

2. The sensing system in accordance with claim 1, wherein said valve is selectively positionable in a second position of the plurality of positions, wherein a second flow channel is defined between said internal flow channel and said sampling chamber through said valve when said valve is in the second position, said second flow channel configured to channel the first fluid into said sampling chamber.

3. The sensing system in accordance with claim 2, wherein said sensor assembly is configured to determine characteristics of the first fluid within said sampling chamber.

4. The sensing system in accordance with claim 2, wherein said valve is selectively positionable between the plurality of positions such that the first fluid and the second fluid are alternatingly sampled within said sampling chamber.

5. The sensing system in accordance with claim 1, wherein said valve comprises a stationary element and a rotatable element, said rotatable element selectively positionable between the plurality of positions such that the first fluid and the second fluid are alternatingly sampled within said sampling chamber.

6. The sensing system in accordance with claim 5, wherein said stationary element comprises a first flow passage in flow communication with said high pressure portion of said venturi device and a second flow passage in flow communication with said sampling chamber.

7. The sensing system in accordance with claim 6, wherein said rotatable element comprises a circumferential slot and a longitudinal slot defined therein, said longitudinal slot in flow communication with said circumferential slot, and said rotatable element being rotatable for selectively aligning said longitudinal slot with said first flow passage or said second flow passage.

8. The sensing system in accordance with claim 1 further comprising:

a first outer casing and a second outer casing coupled on opposing ends of said cylindrical body; and a first chassis and a second chassis coupled on opposing ends of said cylindrical body, said first chassis positioned interior within said first outer casing and said second chassis positioned interior within said second outer casing.

9. A sampling hub for use in a sensing sub-assembly, said sampling hub comprising:

a cylindrical body comprising:

an internal flow channel extending therethrough, said internal flow channel configured to channel a first fluid therethrough;

a sampling chamber defined therein, said sampling chamber coupled in selective flow communication with an ambient environment exterior of said cylindrical body and with said internal flow channel; and at least one sensor chamber defined therein, said at least one sensor chamber in communication with said sampling chamber;

a venturi device coupled within said cylindrical body, said venturi device comprising a high pressure portion and a low pressure portion, wherein said low pressure portion is coupled in flow communication with said sampling chamber; and a valve coupled within said cylindrical body, said valve selectively positionable in at least a first position of a plurality of positions, wherein a first flow channel is defined between said internal flow channel and said high pressure portion of said venturi device through said valve when said valve is in the first position, said first flow channel configured to channel the first fluid towards said high pressure portion such that said low pressure portion draws a second fluid into said sampling chamber from the ambient environment.

10. The sampling hub in accordance with claim 9, wherein said valve is selectively positionable in a second position of the plurality of positions, wherein a second flow channel is defined between said internal flow channel and said sampling chamber through said valve when said valve is in the second position, said second flow channel configured to channel the first fluid into said sampling chamber.

11. The sampling hub in accordance with claim 10, wherein said valve is selectively positionable between the plurality of positions such that the first fluid and the second fluid are alternatingly sampled within said sampling chamber.

12. The sampling hub in accordance with claim 9 further comprising a first sensor positioned within said at least one sensor chamber, wherein said first sensor is configured to determine characteristics of fluid within said sampling chamber.

13. The sampling hub in accordance with claim 9, wherein said valve comprises a stationary element and a rotatable element, said rotatable element selectively positionable between the plurality of positions such that the first fluid and the second fluid are alternatingly sampled within said sampling chamber.

14. The sampling hub in accordance with claim 13, wherein said stationary element comprises a first flow passage in flow communication with said high pressure portion of said venturi device and a second flow passage in flow communication with said sampling chamber.

15. The sampling hub in accordance with claim 14, wherein said rotatable element comprises a circumferential slot and a longitudinal slot defined therein, said longitudinal slot in flow communication with said circumferential slot, and said rotatable element being rotatable for selectively aligning said longitudinal slot with said first flow passage or said second flow passage.

16. The sampling hub in accordance with claim 9, wherein said cylindrical body further comprises:

an interior conduit defined therein, said interior conduit configured to couple the ambient environment in flow communication with said sampling chamber; and a second sensor chamber defined therein and in communication with said interior conduit, wherein a second sensor positioned within said second sensor chamber is configured to measure pressure and temperature of the second fluid channeled through said interior conduit.

17. A drilling assembly comprising:

a first sub-assembly comprising at least one of a measurement-while-drilling sub-assembly or a logging-while-drilling sub-assembly; and a sensing sub-assembly coupled to said first sub-assembly, said sensing sub-assembly comprising:

a cylindrical body comprising:

an internal flow channel extending therethrough, said internal flow channel configured to channel a first fluid therethrough; and a sampling chamber defined therein, said sampling chamber coupled in flow communication with an ambient environment exterior of said cylindrical body;

a venturi device coupled within said cylindrical body, said venturi device comprising a high pressure portion and a low pressure portion, wherein said low pressure portion is coupled in flow communication with said sampling chamber;

a valve coupled within said cylindrical body, said valve selectively positionable in at least a first position of a plurality of positions, wherein a first flow channel is defined between said internal flow channel and said high pressure portion of said venturi device through said valve when said valve is in the first position, said first flow channel configured to channel the first fluid towards said high pressure portion such that said low pressure portion draws a second fluid into said sampling chamber from the ambient environment; and a sensor assembly coupled within said cylindrical body, said sensor assembly configured to determine characteristics of the second fluid within said sampling chamber.

18. The drilling assembly in accordance with claim 17, wherein said valve is selectively positionable in a second position of the plurality of positions, wherein a second flow channel is defined between said internal flow channel and said sampling chamber through said valve when said valve is in the second position, said second flow channel configured to channel the first fluid into said sampling chamber.

19. The drilling assembly in accordance with claim 18, wherein said sensor assembly is configured to determine characteristics of the first fluid within said sampling chamber.

20. The drilling assembly in accordance with claim 18, wherein said valve is selectively positionable between the plurality of positions such that the first fluid and the second fluid are alternatingly sampled within said sampling chamber.

* * * * *